US006080021A

United States Patent [19]

Weingartner

[11] Patent Number: 6,080,021

[45] Date of Patent: Jun. 27, 2000

[54] JACK SOCKET HAVING A TUBULAR GUIDE AND A HOLDER DETACHED FROM ONE ANOTHER

[75] Inventor: Bernhard Weingartner, Feldkirch, Austria

[73] Assignee: Neutrik Aktiengesellschaft, Schaan, Liechtenstein

[21] Appl. No.: 09/198,735

[22] Filed: Nov. 24, 1998

[30] Foreign Application Priority Data

Dec. 9, 1997 [DE] Germany ..... 197 54 527

[51] Int. Cl.[7] ..... H01R 24/04

[52] U.S. Cl. ..... 439/669; 439/926

[58] Field of Search ..... 439/374, 668, 439/669, 926

[56] References Cited

U.S. PATENT DOCUMENTS 5,338,215 8/1994 Lee ..... 439/668

*Primary Examiner*—Lincoln Donovan
*Assistant Examiner*—Javaid Nasri
*Attorney, Agent, or Firm*—McAulay Nissen Goldberg & Kiel, LLP

[57] ABSTRACT

A jack socket for a jack plug has a tubular guide part for receiving the shaft of the jack plug and a holder made from electrically insulating material with contact strips arranged therein. The contact strips have solder lugs which project beyond the holder and can be connected in an electrically conducting manner with the conductors of a printed circuit board. The tubular guide part can be fastened in a bore hole of a housing of a device having the jack socket. The holder grasps the contact strips and, as the case may be, the switching contacts in the immediate region of the solder lugs. The height of the holder amounts to only a portion of the height of the contact strips. The guide part and the holder with the contact strips are separated from one another. The holder is disk-shaped or plate-shaped.

9 Claims, 2 Drawing Sheets

JACK SOCKET HAVING A TUBULAR GUIDE AND A HOLDER DETACHED FROM ONE ANOTHER

BACKGROUND OF THE INVENTION a) Field of the Invention

The invention is directed to a jack socket for a jack plug with a sleeve-shaped or tubular guide part for receiving the shaft of the jack plug and with contact strips which are arranged in a holder made from electrically insulating material, wherein the contact strips have solder lugs which project beyond the holder and can be connected in an electrically conducting manner with conductors of a printed circuit board.

b) Description of the Related Art

Jack sockets are socket connectors for receiving known ¼" jack plugs which are constructed with 2 or 3 contacts. The socket connectors have a tip (contact bulb), as they are called, and a shaft contact in the 2-contact construction or a tip contact, ring contact and shaft contact in the 3-contact construction. The 2-contact construction is used for connecting 1-conductor shielded cable (unbalanced) and the 3-contact construction is used for connecting 2-conductor shielded cable (balanced). The respective jack sockets, of which many embodiment forms are known, accordingly have a hollow-cylindrical guide part for receiving and guiding the plug shaft, wherein this guide part also serves to mechanically connect the plug housing, via the socket housing, to the device housing at which the guide part is fastened and which is usually made of metal and also produces the electrical ground connection between the shaft and the housing. A cylindrical flange of this guide part is connected with a housing that is usually made of plastic or is inserted in such a housing which carries contact strips. In the simplest case, an individual contact strip is provided, namely, the tip contact or bulb contact. In the most elaborate case, five contact strips are provided, namely, a tip contact, a ring contact and two shaft contacts which are electrically connected with the tip and ring in the rest position and which open when the socket connector is inserted. The above-mentioned contact strips usually terminate, at the end opposite to the insertion side, in lugs or pins which are constructed and provided for connection with a printed circuit. The cylindrical guide part mentioned above is provided with an external thread which carries a nut, the socket connector being connected with the housing by this external thread (DE 195 38 725 C1; U.S. Pat. No. 5,522, 738). A mechanical connection is produced in this way between the printed circuit and the housing, which imposes strict requirements on the dimensional stability of both parts.

Assembly is generally carried out in such a way that the socket connectors—for example, there can be fifty or more such socket connectors on a modern mixing console—are initially placed on the printed circuit and then soldered with the conductor paths in the solder bath. The board in its entirety, which is outfitted with these and other components, is then inserted into the housing and screwed in and tightened connector by connector by means of the above-mentioned nut by a time-consuming process.

A disadvantage of these known constructions is their relatively high price due to the fact that they comprise, in principle, three parts to be joined together, namely the guide part with thread, the housing and the contact strips. The above-described assembly is also very complicated and therefore costly because all of the jack sockets fastened to the printed circuit board must be brought into a position coinciding with the bore holes for receiving them in the housing or in a front plate and inserted into these bore holes, and only then can the nuts be screwed on and the jack socket fastened.

OBJECT AND SUMMARY OF THE INVENTION

An object of the present invention is to simplify and reduce the cost of assembling jack sockets of the type mentioned above and to reduce the cost of the structural component part.

This object is met by the invention in that the guide part and the holder with the contact strips are separated from one another during operational use and are arranged at different parts of an electrical device and do not have any direct mechanical connection. The holder grasps, in a positioning manner, the contact strips and, the switching contacts at least in the immediate region of the solder lugs. The holder is held on the printed circuit board exclusively by the solder lugs. The guide part can be fastened in a bore hole of a housing accommodating the printed circuit board with the holder, wherein the axes of the guide part and holder are aligned. This substantially lowers the tolerance requirements for assembling accuracy of the parts because the springing contact strips provide a tolerance compensation and there is no other additional mechanical connection.

In accordance with the present invention, a jack socket is provided which has no housing in practice, and the jack socket comprises two separate parts: the guide part on and the holder with the contact strips guide part is to be fastened to a housing of a device and the holder with the contact strips is fastened to the board of a printed circuit. The two parts are arranged in the correct position, so as to be axially aligned with one another, but spatially separated, only during the final assembly. The guide part has a flange on the outside of the housing and is fastened in a bore hole of the housing either by pressing, by riveting, by means of a spring ring, a wire yoke or link or, if required, by a nut. This can be carried out very quickly. The very light holder with the contact strips can be attached to the board automatically on so-called insertion machines. Due to its low weight, it is held in a dependable manner and there is no risk that it will fall out during the soldering process in the solder wave bath such as often happened with the previous heavy constructions of jack sockets of this kind. The advantages of the present invention are apparent: substantially reduced production costs due to the omission of a housing and of the connection of the housing with a guide part having a costly thread; separate assembly of the guide part and the holder with contact strips, low weight, and no screwing processes.

The invention will be described more fully with reference to the drawing without the invention being limited to the embodiment example shown.

DESCRIPTION OF THE PREFERRED EMBODIMENTS

Figure 1:
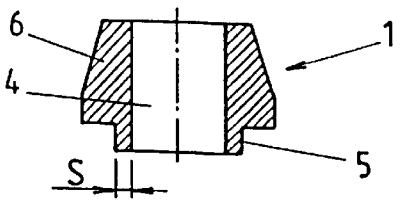
FIG. 1 shows a cross section through the sleeve-type or tubular guide part.

The tubular guide part 1, shown in cross section in FIG. 1, for receiving the shaft 2 of the jack plug 3 has a cylindrical bore hole 4 and a step-like lower portion 5 whose thickness S is narrowed in diameter relative to the portion 6 of the guide part 1. A flange is formed by the step-like lower portion 5, and the guide part can be fastened to the housing 7 of a device utilizing the flange. The guide part 1 is fixed in a bore hole of a housing 7 of the type mentioned above belonging to a device, not shown, by means of riveting in the present embodiment example. The outer side of the portion 5 is advisably rippled or beaded in order to provide a high-quality electrical contact between the guide part 1 and housing 7. It should be noted that other steps which can be carried out mechanically and automatically (via an automated process) can also be used to fix the guide part 1. For example, guide part 1 can be fixed to housing 1 by pressing, by using an arrangement of a spring ring or a wire link; or by securing, a nut can be onto a threaded end of guide part 1. Further, it is possible to fix the guide part by providing a nut which lies on the outer side of the housing 7. When the guide part 1 is riveted, it is generally sufficient if it is widened at least along a portion of its circumference.

Figure 2:
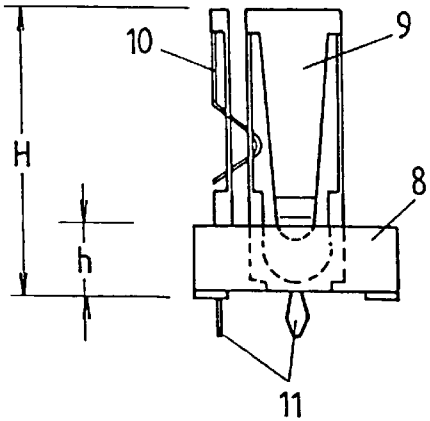
FIGS. 2, 3 and 4 show two side views of a holder with the contact strips and a top view.
Figure 3:
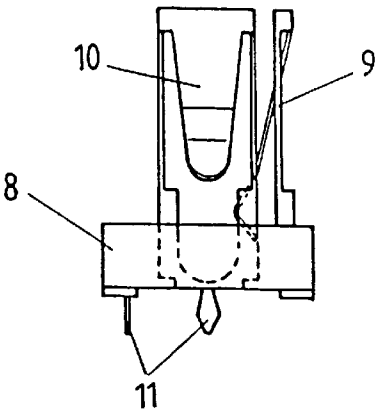
Figure 4:
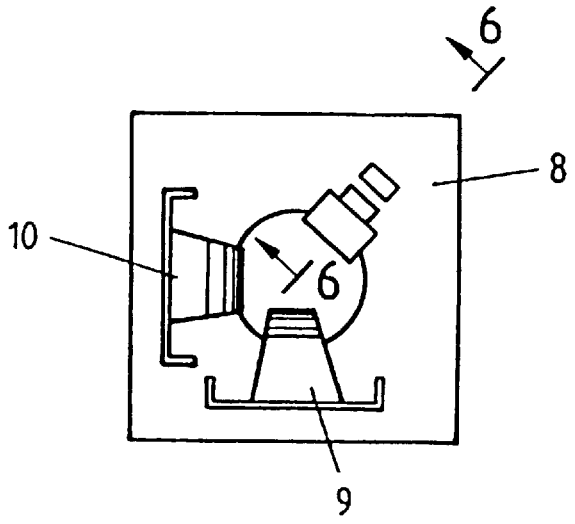
Figure 6:
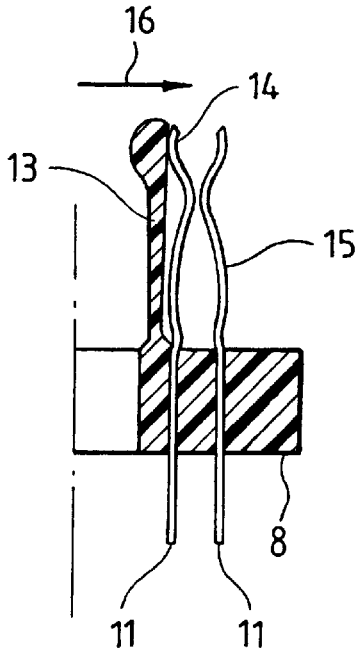
FIG. 6 shows a section of the holder along line A—A shown in FIG. 4.

The jack socket shown in FIGS. 2, 3 and 4 has a plate-shaped or disk-shaped holder 8 made from an electrically insulating material. The holder 8 grasps the contact strips 9 and 10 exclusively in their lower region which is adjacent to the solder lugs 11 of the contact strips, and the solder lugs 11 project down below holder 8 and are precisely positioned. As can be seen from FIGS. 2 and 3, the height h of the holder 8 is only a fraction of the height H of the contact strips 9 and 10. The ratio of the height H of the contact strips 9, 10 to the height of the disk-shaped or plate-shaped holder 8 can be approximately 5:1. The arrangement and formation of the contact strips shown herein is meant only as an example. In an embodiment example shown in FIG. 6, at least one projection or continuation 13 extends parallel to the axial direction of the tubular guide part 1 and can be formed integral with the disk-shaped or plate-shaped holder 8, and a switch contact 14, 15 or a switch strip contacts this continuation 13. This continuation is rod-shaped or pin-shaped and is arranged in a springing manner (i.e., removable in direction 16) relative to the holder 8. Since the subject matter of the invention does not relate directly to the construction of the contact strips and switching strips, the construction and arrangement of these strips is not discussed herein in more detail.

It can also be seen from FIGS. 2 and 3 that the solder lugs 11 have two wedge-shaped portions along their length. The edges of one wedge-shaped portion converge toward its free end and the edges of the other wedge-shaped portion converge toward the holder 8, and the axial lengths of these two portions are approximately equal.

Figure 5:
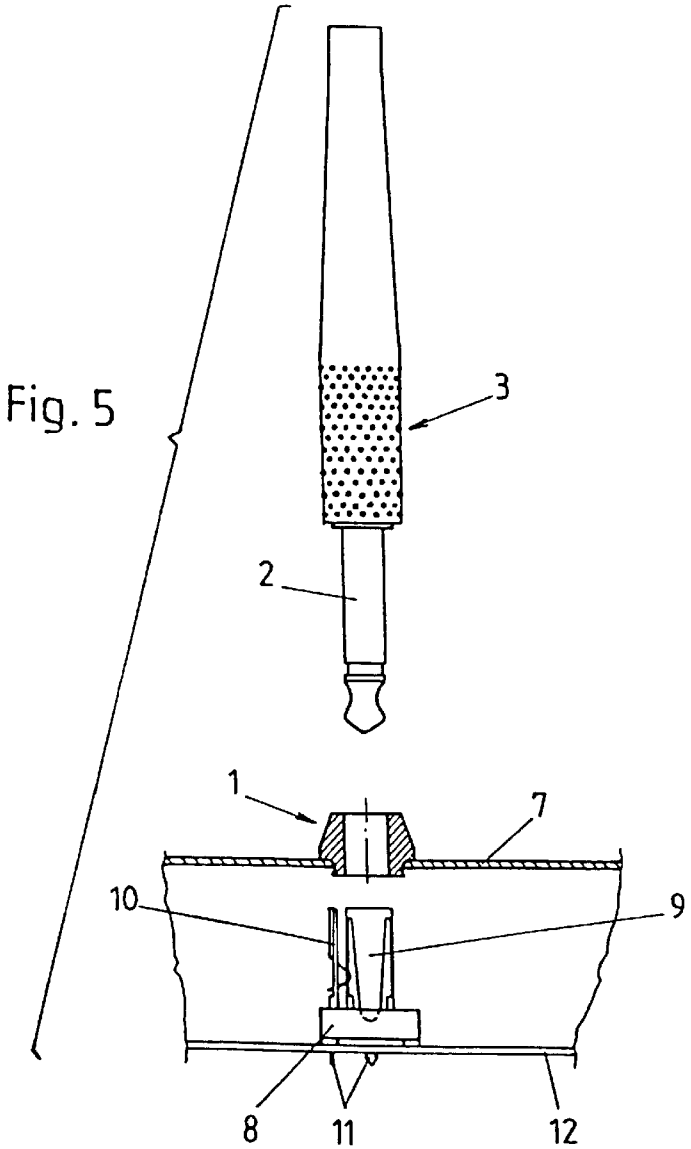
FIG. 5 shows the arrangement of the jack socket in a device and the position of the jack plug before being inserted into the jack socket.

FIG. 5 shows a cross section through a device with the above-described jack socket. The tubular guide part 1 contacts the outer side of the housing 7 of the device and is riveted while the guide part 1 is received within the bore hole receiving it. The holder 8 is fastened to a printed circuit board 12 by solder lugs 11 of the contact strips 9 and 10. There is no direct connection between the guide part 1 and the holder 8 with the contact strips 9 and 10, and no housing is provided for these contact strips. The holder 8 only has the object of fixing the contact strips in their respective position. The axially aligned position between the guide part 1 and the contact strips 9 and 10 is produced only during the assembly of the device. In order to fix the contact strips 9 and 10 at the holder 8, the latter are cast in the material of the holder and glued into corresponding recesses of the holder. The assembly is carried out essentially as follows: the guide part 1 is introduced into the front panel of the housing 7 or into a bore holes provided therein by use of automatic machine and is riveted at the same time in that the portion 5 is widened on at least part of its circumference. At the same time, a holders 8 is attached to a printed circuit board by means of another automatic machine. The construction of the solder lugs 11 selected in this case not only facilitates this placement process, but also ensures the hold of the attached holder 8. The solder lugs 11 move by their conically tapering front ends into the bore holes on a printed circuit board 12 which are provided for receiving them. Since the arrangement is carried out in such a way that these solder lugs 11 do not lie exactly centric to the bore holes, they are deflected to the side somewhat when moving into the bore hole until their largest central cross-sectional dimension has passed the bore hole. They then spring back into their original position. Since there are always a plurality of solder lugs 11 of this type per jack socket, the jack socket is held on the printed circuit board for further handling. The parts which are combined in this way are connected such that they are engaged by the agency of an intermediate material in the subsequent solder bath. The printed circuit board which is prepared and manufactured in this way is now introduced into the housing 7 and positioned in such a way that the guide part 1 and the respective holder are aligned relative to one another. There is no immediate or direct connection between the aforementioned parts, as can be seen from FIG. 5.

The above-mentioned continuations of the holder 8 which are constructed in a pin-shaped or rod-shaped manner and contacted by the contact strips can be arranged in such a way that they have a shoulder which projects relative to the axial center of the holder and projects into the displacement path of the shaft 2 of the jack plug 3, so that this springing pin-shaped or rod-shaped continuation is deflected radially by the insertion of the jack plug 3. This radial deflection can be used for switching purposes when a contact strip is arranged at this continuation in a suitable manner.

This suggestion not only substantially reduces the cost of producing the jack socket compared with previous constructions, but the assembly also takes only a fraction of the time formerly expended.

While the foregoing description and drawings represent the preferred embodiments of the present invention, it will be obvious to those skilled in the art that various changes and modifications may be made therein without departing from the true spirit and scope of the present invention.

| Reference numbers | |
|---|---|
| 1 | guide part |
| 2 | shaft |
| 3 | jack plug |
| 4 | bore hole |
| 5 | portion |
| 6 | portion |
| 7 | housing |
| 8 | holder |
| 9 | contact strip |
| 10 | contact strip |
| 11 | solder lug |
| 12 | printed circuit board |

What is claimed is:

1. A jack socket for a jack plug comprising:

a tubular guide part for receiving a shaft of the jack plug;

a holder, with contact strips arranged therein, made from electrically insulating material;

said contact strips having solder lugs which project beyond the holder and adapted to be connected in an electrically conducting manner with conductors of a printed circuit board;

said guide part and said holder with said contact strips being separated from one another during operational use and being arranged different parts of an electrical device and without direct mechanical connection;

said holder securing said contact strips in a region near the solder lugs;

said holder being held on the printed circuit board exclusively by solder lugs; and said guide part adapted to being fastened in a bore hole of a housing accommodating the printed circuit board with the holder, wherein axes of the guide part and holder are aligned.

2. The jack socket according to claim 1, wherein the holder is disk-shaped or plate-shaped.

3. The jack socket according to claim 1, wherein at least one projection which extends parallel to the axial direction of the tubular guide part is formed integral with the disk-shaped or plate-shaped holder, and one of the contact strips contacts said projection.

4. The jack socket according to claim 3, wherein the projection is rod-shaped or pin-shaped and is adapted to be flexible relative to the holder.

5. The jack socket according to claim 1, wherein the solder lugs have two wedge-shaped portions along their length, wherein the edges of one wedge-shaped portion converge toward its free end and the edges of the other wedge-shaped portion converge toward the holder, and wherein the axial lengths of these two portions are approximately equal.

6. The jack socket according to claim 1, wherein the tubular guide part has a step-like portion to be received in the bore hole of a front panel of the housing, and the outer side of this portion is riffled or beaded.

7. The jack socket according to claim 1, wherein the tubular guide part has a step-like portion to be received in the bore hole of a front panel, and the thickness of the portion is narrowed in diameter substantially relative to an average thickness of another portion of the guide part.

8. The jack socket according to claim 6, wherein the step-like portion of the guide part is adapted to be widened in a rivet-like manner along at least a portion of its circumference in order to fasten the guide part to the housing when the step-like portion is received within the bore hole.

9. The jack socket according to claim 1, wherein the height of the holder amounts to only a portion of the height of the contact strips.

* * * * *